United States Patent [19]

Wittrisch

[11] Patent Number: 4,913,227

[45] Date of Patent: Apr. 3, 1990

[54] EQUIPMENT FOR A DRILL PIPE STRING INCLUDING A SIDE ENTRY SUB, A SAFETY MEMBER FOR ANCHORING A CABLE ON A SUPPORT, AND A METHOD OF USING THE EQUIPMENT

[75] Inventor: Christian Wittrisch, Rueil Malmaison, France

[73] Assignee: Institut Francais du Petrole, Rueil Malmaison, France

[21] Appl. No.: 190,752

[22] Filed: May 5, 1988

[30] Foreign Application Priority Data

May 7, 1987 [FR] France ..... 87 06542
May 7, 1987 [FR] France ..... 87 06543

[51] Int. Cl.[4] ..... E21B 17/046; E21B 23/02

[52] U.S. Cl. ..... 166/117.5; 166/65.1; 166/242; 166/385; 166/382; 175/104; 285/2

[58] Field of Search ..... 166/65.1, 242, 385, 166/117.5, 77, 84; 175/104, 105; 277/102, 105, 110; 285/2, 119

[56] References Cited

U.S. PATENT DOCUMENTS

| | | | |
|---|---|---|---|
| 3,401,749 | 9/1968 | Daniel | 166/77 X |
| 4,062,551 | 12/1977 | Base | 166/242 X |
| 4,200,297 | 4/1980 | Tricon | 166/65.1 X |
| 4,388,969 | 6/1983 | Marshall et al. | 166/385 X |
| 4,457,370 | 7/1984 | Wittrisch | 166/65.1 X |
| 4,506,729 | 3/1985 | Davis, Jr. et al. | 166/242 X |
| 4,524,834 | 6/1985 | Barron et al. | 166/65.1 X |
| 4,570,709 | 2/1986 | Wittrisch | 166/65.1 X |
| 4,603,578 | 8/1986 | Stoltz | 166/242 X |
| 4,607,693 | 8/1986 | Richardson | 166/65.1 X |
| 4,660,635 | 4/1987 | Wittrisch | 166/54.5 |
| 4,678,038 | 7/1987 | Rankin | 166/65.1 X |
| 4,681,162 | 7/1987 | Boyd | 166/242 |

FOREIGN PATENT DOCUMENTS 2502236 9/1982 France .

OTHER PUBLICATIONS

*Composite Catalog of Oil Field Equipment & Services,* 36 Revision, 1984–1985, vol. I and III, published by World Oil, pp. 1300 and 4421.

*Primary Examiner*—Stephen J. Novosad
*Attorney, Agent, or Firm*—Antonelli, Terry & Wands

[57] ABSTRACT

Equipment is provided for drill pipe strings including a side entry sub, allowing a cable to be passed therethrough using if required a safety member for anchorage on a support. Said sub includes more particularly means for sealing about the cable and said entry and isolating a zone inside the sub, which opens at the level of the lower end of the sub and the inner zone has a side opening adapted to be connected to a pumping installation. This anchorage member includes more particularly a body cooperating with a clamping element for defining a passage of variable section for the cable so as to be able to anchor this cable. At least one stop cooperating with a surface is used for varying the section of the passage. The body and the clamping element are locked to the support by means whose release is controlled so as to cause a translational movement of the member inside the support and disengagement of the cable.

21 Claims, 1 Drawing Sheet

EQUIPMENT FOR A DRILL PIPE STRING INCLUDING A SIDE ENTRY SUB, A SAFETY MEMBER FOR ANCHORING A CABLE ON A SUPPORT, AND A METHOD OF USING THE EQUIPMENT

BACKGROUND OF THE INVENTION

1. Field of the Invention

The present invention relates to equipment for rod strings, such as a drill pipe string, including a side entry sub for passing a cable from the inside towards the outside of the pipes, with hydraulic sealing about the cable.

Side entry subs are well known by oil drilling specialists. Such a device is described for example in the British Patent No. 2 135 719.

2. Description of the Prior Art

A side entry sub is described for example in the technique described in French Patent No. 2 501 777 and its first two additions FR-A-2 522 059 and FR-A-2 564 893.

In this technique, which makes it possible to carry out logging or work in horizontal or very slanted wells, a well logging probe (or work tool) is initially fixed to the lower end of a pipe string which is lowered into the well as it is formed.

Then an electric cable, is lowered inside the pipes, by gravity and by pumping. The cable has a weighted connector (the connector having a load bar mounted thereover) which is connected to a complementary connector fixed to the top of the probe (or tool). In the portion of the drill pipe string corresponding to the vertical or slightly slanted portion of the well, a side entry sub allows the cable to be passed from the inside to the outside of the drill pipes.

Recording of the measurement (or work in the well) is carried out by moving the whole of the drill pipe string from the surface.

The equipment with side entry sub used at the present time cannot be used when the dimensions of the well are too small. This occurs more particularly when a small diameter bore hole has been cased.

In providing compact equipment which overcomes this difficulty, the present invention provides a connection allowing fluid flow in the lower portion of the drill pipe string, for the purpose of moving parts, tools, load bars . . . connected by a cable to the surface installations.

SUMMARY OF THE INVENTION

This equipment for drill pipe strings includes a side entry sub, the sub having an upper end and lower end and being adapted for incorporation in a drill pipe string, the side entry of the sub allowing a cable to be passed therethrough. It is characterized more particularly in that the sub includes means for sealing about the cable with the side entry and isolating a zone inside the sub, the inner zone being situated under said sealing means and opening at the level of the lower end into a lower portion of the drill pipe string, and in that the sub includes a side opening adapted to be connected to a pumping installation.

The sealing means may include two complementary parts adapted so as to be sealed against the passage of fluid from the inside to the outside and reciprocally and adapted to be placed about a cable, said two parts defining an inner form, these sealing means including internal means adapted for cooperating with the inner form and cable so as to provide sealing between the cable and the two complementary parts, said sealing means further including external means adapted for cooperation with the two parts and the sub so as to provide sealing.

The sub may include an anchorage member for anchoring the cable to said sub.

The anchorage member may include means adapted for releasing the cable under the action of a remote control.

The release means may be actuated by a tractive force exerted by the cable.

The anchorage member may be expandable for releasing the cable.

The cable section situated in line with the two complementary parts may be rectilinear and have an axis substantially parallel to the axis of said sub.

The cable section situated in line with the two complementary parts may have an axis substantially merging with the axis of said sub.

The anchorage member and the sealing means may be integrated with each other.

The diameter of the upper elements may be substantially equal to or less than the diameter of the lower elements.

The present invention also provides equipment for a drill pipe string including a side entry sub for passing a cable therethrough, this sub having an upper end and a lower end and being adapted to be incorporated in a drill pipe string having upper elements cooperating with said upper end and comprising lower elements cooperating with said lower end. This equipment is characterized more particularly in that the outer diameter of the upper elements of the drill pipe string is less than the external diameter of the lower elements of the drill pipe string.

This sub may be adapted so that the lower and upper elements have a substantially common generatrix.

The diameter of the upper elements may be substantially equal to or less than the diameter of the lower elements.

Furthermore, the present invention relates to a method of using said equipment and is more particularly characterized in that fluid is caused to flow in the lower portion of the drill pipe string by connecting the lower portion of the drill pipe string to the pumping installation through the side opening.

A load bar placed in the lower portion and connected to the cable may be moved by the fluid flow inside the lower portion of the drill pipe string.

The present invention also provides a safety anchorage member for a cable. This member is adapted particularly so as to be disposed inside a side entry sub. This safety anchorage member has a body and a clamping element defining a passage for the cable, this passage having a variable section over a part at least of the length of the passage, the anchorage member being retained inside the support by releasable locking means, the body cooperating with the installation so as to reduce the passage section for the cable, for clamping this cable. This anchorage member further includes at least one stop adapted for modifying the section by movement of the clamping element relatively to the body by bearing on the support and on the surface of the element, the surface having a shape adapted for increasing the section of the passage and for disengaging the cable when the locking means release the anchorage member and when a sufficient translational movement of the body occurs with respect to the support.

The body may be adapted for moving the clamping element during the translational movement of the body.

The means for locking the anchorage member and the cable may be released by remote control.

The locking means may be released under the action of the tractive force exerted by the cable from the surface.

The locking means may include a pin which is shearable beyond a certain stress threshold.

The surface of the anchorage member may have at least one portion slanted through a certain angle with respect to the oriented translational axis of the anchorage member relative to the support, the slanted portion being oriented in the direction away from the passage and the slant angle, between the oriented axes of the translational movement and of the slanted portion, will be an acute angle.

The surface of the anchorage member may be crenellated and have at least one indentation and the stop may be adapted for penetrating into the indentation when the translational movement is carried out.

The anchorage member may be adapted for the side introduction of the cable into the passage.

The anchorage member may include means providing sealing about the cable with the inside of the support.

BRIEF DESCRIPTION OF THE DRAWINGS

The invention wll be better understood and all its advantages will be clear from the following description, an embodiment of which is illustrated in the accompanying drawings in which.

DESCRIPTION OF THE PREFERRED EMBODIMENTS

Figure 3:
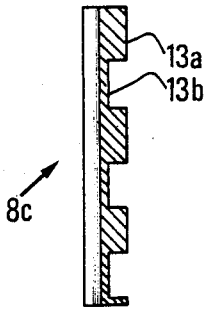
FIG. 3 is a section of a second embodiment of the anchorage member.
Figure 2:
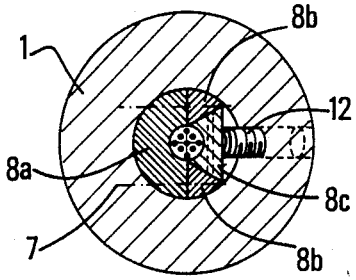
FIG. 2 is a section of a detail of the anchorage member.

Reference 1 designates the tubular body of the side entry sub screwed by its upper end 1*a* and lower end 1*b* , respectively, to an upper element 2 and a lower element 3 of the drill pipe string.

This sub has a side entry 5 for passing an electric cable 4 from the outside to the inside of the pipes, while bearing on two guide rollers 6*a* and 6*b*. This cable is for example of a type used for well logging or work carried out using the technique described in patent FR-A-2 501 777 and its additions mentioned above.

The upper end 1*a* may include a plug for closing the upper element 2.

Member 8 provides sealing about cable 4 between a zone 9 inside sub 1 and the outside of the sub.

The inner zone 9 opens into the lower part of the drill pipe string through the lower element 3. This inner zone 9 communicates with a side opening 10 situated in the sub and which may be connected to a pumping installation producing a fluid flow for moving tools and measuring or work instruments connected or not to the cable 4. One of these instruments may be a load bar having an electric connector adapted for cooperating with another complementary electric connector.

Member 8 further anchors cable 4 to said sub 1.

The means of sub 1 specifically intended for sealing and carried by member 8 include two complementary parts 8*a*, 8*b* assembled together by screws 7 and adapted to be placed about cable 4 and to be sealed to the passage of fluid from inside to outside and reciprocally. The inside of these parts is bored so as to be able to place therein deformable rings 16 and a compression ring 17 an to keep these rings locked in one direction. All these rings, or some of them only, are split so as to be able to be positioned once the cable passes through sub 1.

A nut 18, having a side opening for fitting about cable 4 and on member 8, serves for compressing the deformable washers 16 so as to provide sealing. The assembly constituting the internal sealing means and including the two complementary parts 8*a*, 8*b*, the deformable washers 16, the half moon compression washer 17 and a nut 18 corresponds to the packing generally used for this purpose.

The external sealing means include two complementary parts or bodies 8*a*, 8*b* cooperating with one or more external seals 14, such as an O-seal, and the internal wall of sub 1.

The anchorage member specifically intended for locking the cable 4 with respect to sub 1 and carried by member 8 includes the two compelementary parts or bodies 8*a*, 8*b* and a clamping element 8*c* actuated by clamping screws 12.

One 8*b* of the complementary parts or bodies 8*a*, 8*b* includes a widened recess opening onto cable 4 and in which the clamping element 8*c* is positioned which, under the action of teat screws 12, prevents cable 4 from moving.

These screws 12, include sealing means preventing the passage of fluid between their bodies and the holes in which they are housed.

The teats of these screws 12 act on the clamping element 8*c* through disengagement surfaces 13.

The sealing and anchorage member 8 further includes a stud 19 cooperating with a groove 20 in sub 1, both being adapted so as to allow relative movement during disengagement of the cable.

Member 8 is locked with respect to sub 1 by a shearable pin 11 whose shearing releases member 8 for translational movement when a tractive force is exerted on cable 4.

The equipment is used as follows, when the side entry sub is accessible, for example when it is close to the surface.

After removing member 8 and the guide roller, an end of the cable is inserted through entry 5, then member 8 is placed about cable 4, then member 8 is positioned in sub 1 before placing stud 19 which it comprises in groove 20 and before locking member 8 by means of the shearable pin 11.

the sealing 12*a* provided by the teat studs 12 is checked, the inner zone 9 of the sub is connected to the pumping installation through the side opening 10 and fluid is caused to flow.

When it is desired to anchor the cable to the sub, screws 1 are tightened so that the clamping element 8*c* cooperating with the two complementary parts 8*a*, 8*b* cooperating with this element, locks cable 4.

The clamping screws play the role of adjustable stops but fixed stops could also be used. Thus, when the disengagement surfaces are slanted, the cable may be clamped by jamminng the anchorage member, or more precisely, the clamping element, inside the sub, by axial pressure on said member, or by self jamming of the cable once jamming has begun.

To withdraw cable 4 from the drill pipe string 3 it is sufficient to carry out the above operations in reverse order.

However, if for any reason if it were not possible or if one did not wish to withdraw the cable using this procedure, as may be the case when the string is jammed in the well, it is possible to exert a sufficient tractive force on the cable to shear pin 11 and thus move member 8 relatively to sub 1 over a sufficient distance so that the teats of screws 12 no longer act on the disengagement surfaces 13.

When screws 12 release the clamping element 8*c*, the cable runs freely inside member 8 and sub 1, until it is possible to completely withdraw the cable and thus to carry out operations, such as unjamming of the string, which the presence of the cable might prevent.

Figure 1A:
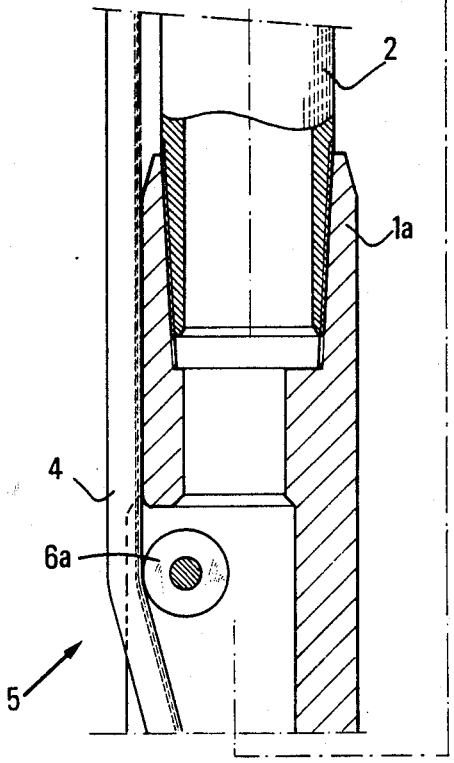
FIG. 1*a* and 1*b* substantially adjacent sections of a sub in accordance with the invention, with the sealing means and the anchorage member shown in detail.
Figure 1B:
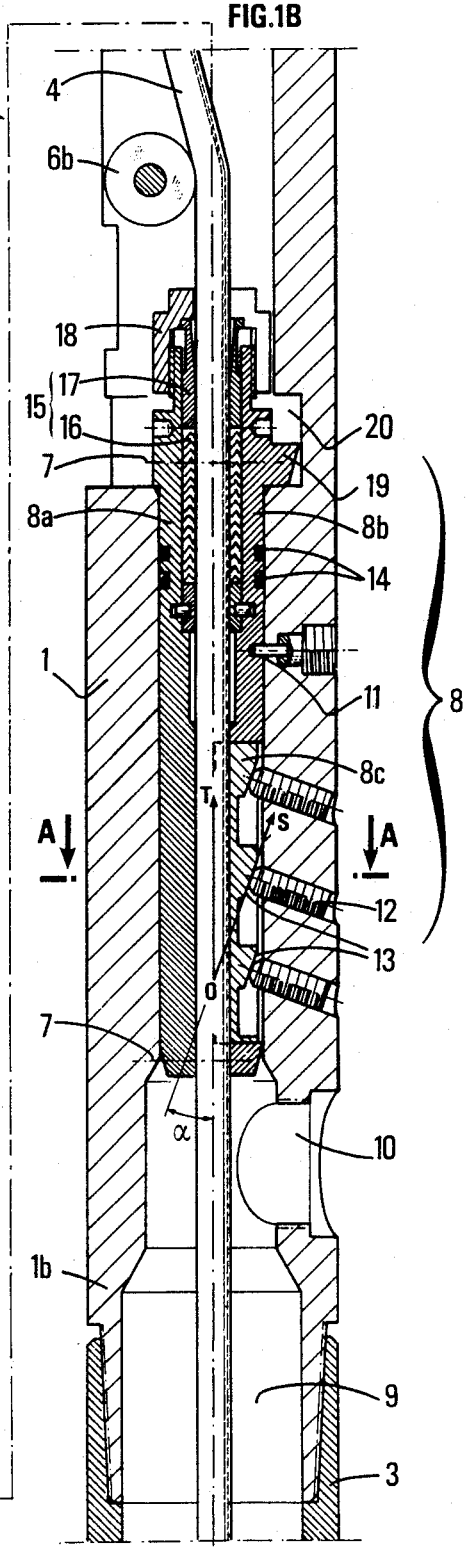

The disengagement surfaces 13 shown in FIGS. 1A and 1B have a slope whose inclination is adapted to increase the clearance between the anchorage member 8*c* and the teats of screws 12 when member 8 follows the movement of the cable imparted by a tractive force exerted thereon. Thus, if the slanted part of the disengagement surface 13 is oriented in direction OS away from the passage, the angle $\alpha$ between the oriented axes of the translational movement OT and of the slanted portion is an actute angle. Thus, the apex of this acute angle is oriented downwardly with respect to the well, namely in the direction opposite that in which the tractive force will be exerted for releasing the cable.

FIG. 3 shows a second embodiment of the clamping element, in which the disengagement surfaces include a portion 13*a* without slant on which the teat of one of the screws 12 may bear, followed by a portion 13*b*, so that the clearance between teat and anchorage member 8 c increases suddenly. The surface has then a crenellated shape 13*a*, 13*b* in which the tops 13*a* correspond to the clamping positions of the clamping element 8*c* and in which the indentations 13*b* correspond to the disengagement positions of the cable.

However, the slanted disengagement surfaces allow the cable to be released after a slight movement of member 8 and provide a greater accuracy in the tractive force threshold to be exerted for shearing pin 11.

Preferably, in accordance with the present invention, the axes of screws 12 may be substantially perpendicular to the disengagement surfaces 13. Thus, the area of the surfaces of the teats in contact with the slanted portions of the disengagement surface 13, or in contact with portions 13*a* in the second embodiment, will be the greatest possible.

With the sub of the invention, two and $\frac{7}{8}$inch VAM lower drill string elements may be connected to 2 and $\frac{3}{8}$ inch VAM upper elements, which correspond respectively to external diameters of 85 mm and 73 mm.

This reduction of diameter allows a cable to run along the upper elements of the drill pipe string as far as the upper end of the well, particularly when the lower and upper elements of the drill pipe string are off-set. An advantageous off-set may be obtained when the lower and upper elements have a substantially common generatrix.

Covers may be used for applying the cable on the upper elements of the drill pipe string.

What is claimed is:

1. A side entry sub for incorporation in a drill pipe string, said sub comprising a tubular body having an upper end and a lower end adapted to be connected with elements of the drill pipe string and having a side entry for allowing a cable to be passed therethrough; said sub further comprising means for sealing about the cable upon entry of the cable into the tubular body and for isolating an inner zone inside the tubular body, said inner zone being situated below said means and being adapted to be in fluid communication with a lower element of the drill pipe string and a side opening in said tubular body, said opening being in fluid communication with said inner zone and being adapted to be connected to a pumping installation.

2. A side entry sub according to claim 1, wherein said sealing means includes two complementary parts adapted to be sealed against passage of fluid into or out of said inner zone and adapted to be placed about the cable, said two parts defining an inner form, said sealing means further including internal means adapted to cooperate with said inner form and cable to provide sealing between said cable and said two complementary parts, said sealing means further including external means adapted to cooperate with said two parts and said sub to provide sealing therebetween.

3. A side entry sub according to claim 1 or claim 2, wherein said sub includes an anchorage member for anchoring the cable to said tubular body.

4. A side entry sub according to claim 3, wherein said anchorage member includes release means adapted for releasing said cable under the action of a remote control.

5. A side entry sub according to claim 4, wherein said release means is actuated by a tractive force exerted by said cable.

6. A side entry sub according to claim 1, wherein said sub includes an anchorage member for anchoring the cable to said tubular body and said anchorage member is retractable for releasing said cable.

7. A side entry sub according to claim 1, wherein a cable section situated in line with said two complementary parts is rectilinear and has an axis substantially parallel to an axis of said tubular body.

8. A side entry sub according to claim 1, including an anchorage member for anchoring a cable to the tubular body, said anchorage member and said sealing means being integrated with each other.

9. A method of using the side entries sub as claimed in claim 1, wherein fluid is caused to flow in the lower portion of the drill pipe string by connecting said lower portion of the drill pipe string to a pumping installation through said side opening.

10. The method as claimed in claim 9, wherein a load bar placed in said lower portion and connected to said cable is moved by fluid flow inside the lower portion of the drill pipe string.

11. Safety anchorage member for anchoring a cable on a support, wherein said anchorage member includes a body and a clamping element defining a passage for said cable, said passage having a variable section over a part at least of the length of the passage, said anchorage member being retained inside said support by releasable locking means, said body cooperating with said clamping element so as to reduce the passage section for said cable, for clamping this cable and said anchorage member further includes at least one stop adapted for modifying said section by movement of said clamping element relatively to said body by bearing on said support and on a surface of said element, said surface having a shape adapted for increasing the section of said passage and for disengaging said cable when the locking means release the anchorage member and when a sufficient translational movement of the body occurs with respect to said support.

12. Safety anchorage member as claimed in claim 11, wherein said body is adapted for moving the clamping element during the translational movement of the body.

13. Safety anchorage member as claimed in any one of claims 11 and 12 wherein release of said means for locking said anchorage member and said cable is by remote control.

14. Safety anchorage member as claimed in claim 13, wherein said locking means are released under the action of the tractive force exerted by said cable.

15. Safety anchorage member as claimed in claim 11, wherein said locking means include a pin which is shearable beyond a certain stress threshold.

16. Safety anchorage member as claimed in claim 11, wherein a surface of said anchorage member includes at least one portion slanted through a certain angle with respect to the oriented translational axis of said anchorage member, said slanted portion being oriented in the direction away from said passage and said slant angle, between the oriented axes of the translational movement and of the slanted portion, is an acute angle.

17. Safety anchorage member as claimed in claim 11, wherein a surface of the anchorage member is crenellated and includes at least one indentation and said stop is adapted for penetrating into said indentation when said translational movement is carried out.

18. Safety anchorage member as claimed in claim 11, adapted for the side introduction of the cable into said passage.

19. Safety anchorage member as claimed in claim 11, including means providing sealing about said cable with the inside of said support.

20. A side entry sub for incorporation into a drill pipe string, said sub comprising a tubular body having an upper end and a lower end adapted to be connected with elements of the drill pipe string and having a side entry for allowing a cable to be passed therethrough; the upper end being adapted to cooperate with upper elements of the drill pipe string and the lower end being adapted to cooperate with lower elements of said drill pipe string, respectively, and the upper end of the tubular body having an outer diameter that is less than an outer diameter of the lower end of the tubular body whereby said sub is adapted to be incorporated in a drill pipe string wherein the outer diameter of the upper elements of the drill pipe string is less than the outer diameter of the lower elements of the drill pipe string and a cable passing through said side entry is allowed to extend along the upper elements outside of the drill pipe string.

21. A side entry sub according to claim 20, wherein said tubular body has an offset at the upper end which allows the lower and upper elements of the drill pipe string to have a substantially common generatrix.

* * * * *